US005165342A

United States Patent [19]

Weishew

[11] Patent Number: 5,165,342

[45] Date of Patent: Nov. 24, 1992

[54] EVACUATION SYSTEM FOR INKING CHAMBER

[75] Inventor: Joseph J. Weishew, Oreland, Pa.

[73] Assignee: The Langston Corporation, Cherry Hill, N.J.

[21] Appl. No.: 739,756

[22] Filed: Aug. 2, 1991

[51] Int. Cl.[5] ..... B41F 31/06

[52] U.S. Cl. ..... 101/364; 101/350; 101/210

[58] Field of Search ..... 101/350, 363, 366, 364, 101/365, 207, 208, 209, 210; 137/395, 409, 410, 413, 414, 497

[56] References Cited

U.S. PATENT DOCUMENTS 3,800,702 4/1974 Roberts ..... 101/425
4,304,611 12/1981 Ellis ..... 15/302
4,930,416 6/1990 Kawabata et al. ..... 101/364

*Primary Examiner*—Edgar S. Burr
*Assistant Examiner*—Ren Yan
*Attorney, Agent, or Firm*—Seidel, Gonda, Lavorgna & Monaco

[57] ABSTRACT

An apparatus for evacuating ink from the inking trough of a flexographic printing machine uses an air ejector nozzle in the ink drain line to draw ink from the trough. The apparatus includes an air-operated control system in which air valves control an air-bladder pinch valve in the ink drain line and an oil-bladder pinch valve in the air ejector line. An air pressure regulator maintains a pressure charge on an accumulator associated with the oil-bladder pinch valve, in order to provide a gradual increase of air flow to the ejector nozzle to prevent sudden vacuum surge that might over-flex the doctor blades.

5 Claims, 1 Drawing Sheet

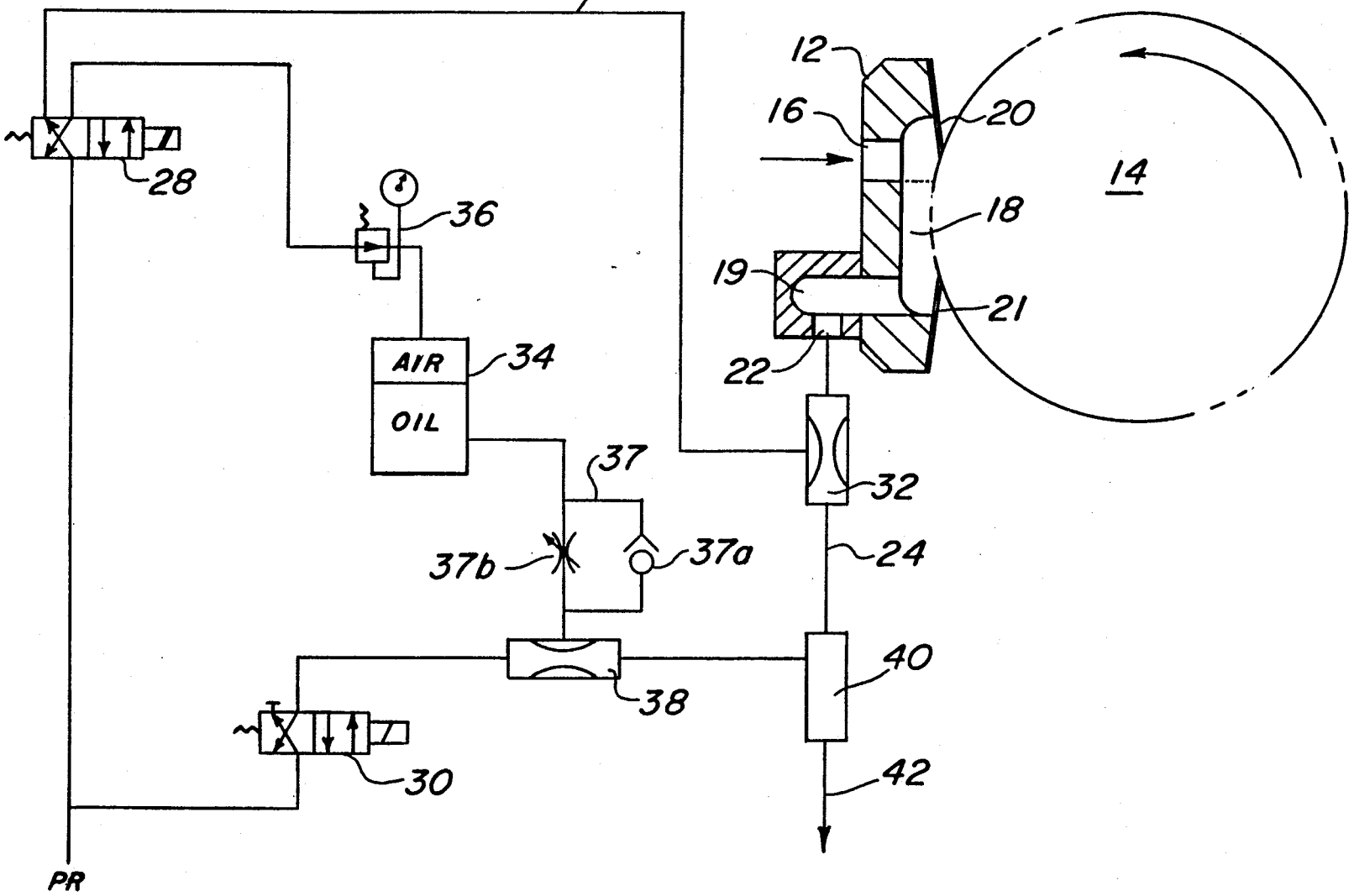
14
20
18
21
12
16
19
22
32
24
40
42
10
37a
37
38
37b
34
AIR
OIL
36
30
28
PR

EVACUATION SYSTEM FOR INKING CHAMBER

BACKGROUND OF THE INVENTION

This invention is related to flexographic printing machines of the type which use an ink chamber with doctor blades as a trough to apply aniline ink to a roller. It is particularity related to mechanisms for draining ink from the chamber for cleaning or color change.

An inking trough of this general type, with an automatic washing system, is disclosed in U.S. Pat. No. 3,800,702 (L. Roberts). In machines of the type disclosed in the patent, the ink is drained from the trough or chamber by gravity feed or by mechanical pumping prior to the wash-up cycle. High viscosity ink drains slowly under gravity feed alone. Consequently, pumping is preferred for rapid ink changes, but mechanical pumps accumulate coatings of dried ink and require frequent disassembly and cleaning.

Consequently, an object of this invention is to provide an improved ink evacuation system for the ink chamber which evacuates the ink rapidly, but does not require the evacuated ink to pass through a mechanical pump.

SUMMARY OF THE INVENTION

An ink evacuation apparatus is provided in which an air ejector nozzle in the ink drain line draws ink from the ink chamber. The apparatus includes an air-operated control system in which air valves control an air-bladder pinch valve in the ink drain line and an oil-bladder pinch valve in the air ejector line. An air pressure regulator maintains a pressure charge on an accumulator associated with the oil-bladder pinch valve, in order to provide a gradual increase of air flow to the ejector nozzle to prevent sudden vacuum surge in the ink chamber that might over-flex the doctor blades.

BRIEF DESCRIPTION OF THE DRAWING

For the purpose of illustrating the invention, there is shown in the drawings a form which is presently preferred; it being understood, however, that this invention is not limited to the precise arrangements and instrumentalities shown.

FIG. 1 is a schematic diagram of an ink evacuation apparatus according to the invention.

DESCRIPTION OF THE BEST MODE

As shown in FIG. 1, an ink evacuation system 10 is used in conjunction with a conventional doctor-blade inking trough 12 for maintaining a consistent layer of aniline ink on a roller 14. The trough 12 has a supply port 16 for introducing ink to a chamber 18 (or trough) extending the length of the roller. The circumference of the roller 14 extends into the chamber 18 to pick up ink. Two doctor blades 20, 21 scrape off excess ink and provide a seal against foreign material entering the chamber. The chamber 18 has a drain well 19 as its lowest point, and a drain port 22 which exits to a drain line 24. Those familiar with the art will recognize the above described features, and that there are other trough systems with different configuration but similar features.

However, the system 10 includes a novel ink evacuation apparatus in which an air ejector nozzle in the ink drain line draws ink from the ink chamber 18, and an air-operated control system in which air valves control an air-bladder pinch valve in the ink drain line and an oil-bladder pinch valve in the air ejector line, as described hereafter.

Thus, pressurized air is supplied through a manifold (not shown), where it is available to the inlets of air valves 28 and 30. In its normal operating position, as shown in FIG. 1, air valve 28 routes air pressure to an air bladder type pinch-valve 32 in the drain line 24. The air pressure inflates the bladders of valve 32 to cap and hold closed the drain line and prevent ink from flowing out of the chamber. When valve 28 is moved to its alternate position at the initiation of a drain-cycle, air from the bladders is vented back through valve 28 and out of the system, allowing the bladders in valve 32 to deflate and opening the drain line. In this alternate position, valve 28 also delivers air pressure to a an oil-pressure accumulator 34, through a regulator valve 36 which maintains the pressure in the accumulator in a set range. The oil in the accumulator is in open communication with oil supplied to the bladders of an oil bladder pinch valve 38 through a directional flow control valve 37. Valve 37 has parallel valve assemblies; a one-way valve assembly **37*a* oriented to allow fluid passage only in the direction from the accumulator to the bladders, and an adjustable opening valve 37*b*** to allow selectively restricted flow in either direction.

In its normal operating position as shown in FIG. 1, air valve 30 blocks air from flowing through bladder valve 38. At a brief delay interval (~5 seconds) following the initiation of the drain cycle, valve 30 is moved to its alternate position in which it supplies pressurized air to through valve 38 to an air ejector assembly 40 in drain line 24. Air ejector assembly 40 has a nozzle which directs high velocity air toward a discharge tube 42. Ink from drain line 24 is allowed to flow around the nozzle and is sucked down the drain line 24 by the lower pressure caused by the high velocity air flow.

The ink is sucked out of the chamber 18 as effectively as if it where drawn out by a mechanical pump. However, if the air flowing through the nozzle were allowed to reach its full volume immediately, the resulting vacuum surge would be transmitted back into the ink chamber 18 and could potentially over-flex the doctor blades. Consequently, the oil bladders of valve 38 act as a flow limiter until the air pressure from valve 30 pushes the oil back into the accumulator. This gradual collapse of the oil bladders results in a brief but gradual build-up of suction in the drain line 24.

An air pressure regulator maintains a pressure charge on an oil reservoir associated with the oil-bladder pinch valve to gradually increase the air flow to the ejector nozzle to prevent sudden vacuum surge in the ink chamber that might over-flex the doctor blades.

The present invention may be embodied in other specific forms without departing from the spirit or essential attributes thereof and, accordingly, reference should be made to the appended claims, rather than to the foregoing specification, as indicating the scope of the invention.

I claim:

1. An apparatus for evacuating ink from the inking trough of a printing machine, comprising:

a drain tube from substantially the lowest point of the trough for draining ink from the trough;

a valve for selectively opening or closing the drain tube;

a discharge tube for receiving ink from the drain tube and discharging said ink from the apparatus;

a source of pressurized air;

an air ejector assembly connected between the drain tube and the discharge tube, said air ejector assembly including means to receive pressurized air from said source and to direct high velocity air into the discharge tube to thereby induce below-atmospheric pressure gradient in the drain tube to increase the rate of flow of ink through the drain tube when said air ejector assembly is operated to evacuate the trough;

and means for actuating the air ejector assembly without producing a vacuum surge including means for graduating the flow rate of pressurized air to the air ejector assembly so that the below-atmospheric pressure gradient is gradually induced.

2. An apparatus as in claim 1, in which the means for graduating the flow rate of pressurized air comprises:

an air valve connected between said source and the air ejector assembly for selectively supplying pressurized air to the air ejector assembly;

a hydraulic bladder pinch-valve connected between said air valve and the air ejector assembly, said pinch valve being controlled to have pressurized liquid in its bladders when said air valve is opened to constrict the initial rate of air flow to the air ejector assembly, and said pinch valve permitting a gradual outflow of liquid from its bladders under the influence of pressure from the air flow to progressively decrease the air flow constriction and thus allow air to flow to the ejector assembly at an increasing rate.

3. An apparatus as in claim 2, wherein said liquid bladder pinch valve is so controlled by a hydraulic pressure accumulator connected to said bladders to permit pressurized liquid to flow between said bladders and said accumulator to maintain a regulated pressure in the accumulator.

4. An ink evacuation apparatus for evacuating ink from a printing machine of the type having an enclosed ink trough, an inking cylinder extending into said trough and one or more flexible doctor blades disposed against said cylinder, said ink evacuation apparatus comprising:

a drain line connected to substantially the lowest point of said trough for draining ink from the trough;

valve means for selectively opening or closing said drain lines;

an air ejector assembly disposed in said drain line and connected to a source of pressurized air to receive pressurized air from said source and to eject said air into the drain line to induce a pressure gradient in the drain line when the valve means is opened to increased the rate of flow of ink draining from the trough;

and means for actuating the air ejector assembly without producing a vaccum surge including means for graduating the flow of pressurized air to the air ejector assembly so that said pressure gradient is gradually induced.

5. An apparatus as in claim 4, in which the means for graduating the flow of pressurized air comprises:

an air valve to selectively open or close air communication between the air source and the air ejector assembly;

a pinch-valve of the hydraulic bladder type located in said air line;

a hydraulic pressure accumulator operably connected to the bladder of said pinch valve to permit hydraulic fluid to flow between said bladder and said accumulator to maintain a regulated pressure in the accumulator and bladder, whereby said hydraulic pressure expands the bladder while the air valve is closed and thereby constricts the initial rate of air flow to the air ejector assembly after the air valve is opened until backflow of hydraulic fluid from said bladder to the accumulator, under the influence of pressure from said air flow, progressively decreases the constriction and allows air flow to the ejector assembly to increase.

* * * * *